US010006254B2

(12) United States Patent
Shi

(10) Patent No.: US 10,006,254 B2
(45) Date of Patent: Jun. 26, 2018

(54) PAIRED HELICALLY INDENTED METHODS AND SYSTEMS FOR VIV SUPPRESSION OF DRILLING RISER BUOYANCY MODULE FOR FLUID SUBMERGED CYLINDERS

(71) Applicant: CBM International, Inc., Houston, TX (US)

(72) Inventor: Shan Shi, Houston, TX (US)

(73) Assignee: CBM International, Inc., Houston, TX (US)

( * ) Notice: Subject to any disclaimer, the term of this patent is extended or adjusted under 35 U.S.C. 154(b) by 0 days. days.

(21) Appl. No.: 15/347,998

(22) Filed: Nov. 10, 2016

(65) Prior Publication Data

US 2017/0183917 A1 Jun. 29, 2017

Related U.S. Application Data

(63) Continuation of application No. 29/549,624, filed on Dec. 28, 2015.

(60) Provisional application No. 62/271,409, filed on Dec. 28, 2015.

(51) Int. Cl.
*B63B 22/00* (2006.01)
*E21B 17/01* (2006.01)

(52) U.S. Cl.
CPC ..... *E21B 17/012* (2013.01)

(58) Field of Classification Search
CPC ..... B63B 21/20; B63B 2021/20; B63B 2021/203; B63B 2021/206; B63B 2021/222; E21B 17/012
USPC ..... 441/133; 405/216; 166/345, 350, 367
See application file for complete search history.

(56) References Cited

U.S. PATENT DOCUMENTS

| | | | | |
|---|---|---|---|---|
| 6,712,559 | B2 * | 3/2004 | Lenormand | E21B 17/012 166/350 |
| 6,948,884 | B2 | 9/2005 | Xu et al. | |
| 7,628,665 | B1 | 12/2009 | Cook et al. | |
| 8,443,896 | B2 * | 5/2013 | Howard | E21B 17/012 166/345 |
| 2003/0143035 | A1 * | 7/2003 | Karayaka | B63B 43/00 405/224.2 |
| 2006/0177276 | A1 * | 8/2006 | Stassen | E21B 17/012 405/224.3 |
| 2010/0307762 | A1 * | 12/2010 | Howard | E21B 17/012 166/350 |

OTHER PUBLICATIONS

Marcollo et al. "Drag reduction and VIV suppression behavior of LGS technology integral to drilling riser buoyancy units", Proceedings of the ASME 2016 35th International Conference on Ocean, Offshore and Arctic Engineering, Jun. 19, 2016.

* cited by examiner

*Primary Examiner* — Daniel V Venne
(74) *Attorney, Agent, or Firm* — Pierson IP, PLLC

(57) ABSTRACT

Embodiments disclosed herein describe cylindrical structures with indents configured to reduce vortex induced vibrations (VIV). For example, the cylindrical structures may be configured to reduce VIV for drilling risers subject to ocean currents. In embodiments, the indents may be positioned on an outer surface of the cylindrical structures, wherein the indents may be parallel pairs. The pairs may be mirrored between a first end and a second end of the cylindrical structure, and be positioned in a helical pattern, which may be continuous or staggered.

3 Claims, 6 Drawing Sheets

PAIRED HELICALLY INDENTED METHODS AND SYSTEMS FOR VIV SUPPRESSION OF DRILLING RISER BUOYANCY MODULE FOR FLUID SUBMERGED CYLINDERS

CROSS-REFERENCE TO RELATED APPLICATIONS

This application claims a benefit of priority under 35 U.S.C. § 119 to Provisional Application No. 62/271,409 filed on Dec. 28, 2015 which is fully incorporated herein by reference in its entirety.

BACKGROUND INFORMATION

Field of the Disclosure

Examples of the present disclosure relate to helically indented drilling riser buoyancy modules. More specifically, embodiments relate to drilling riser buoyancy modules configured to reduce vortex induced vibrations for submerged cylinders.

Background

Offshore drilling is a process where a wellbore is drilled below a seabed. Offshore drilling is more challenging than land-based due to remote and harsher environments, wherein components for offshore drilling are required to be submerged in water.

In conventional offshore drilling platforms, drilling risers are submerged in fluid, wherein the structures are used to drill the formation below a seabed. Drilling risers are partially supported via buoyancy modules that reduce the load on the drilling platforms. As fluid currents pass by the outer surface of the buoyancy modules, vortices shed alternately from the sides of the riser buoyancy modules and travel downstream. This phenomenon is known as "Karman vortex street."

The frequency and magnitude of the vortex shedding is determined by the current's speed and the cross-sectional profile of the cylindrical structures. As a result of the vortex shedding, oscillating lift forces are produced. These lift forces are generally normal to the axis of the buoyancy modules and predominately in a cross-flow direction. This causes forced oscillations of the buoyancy modules, known as vortex induced vibrations (VIV).

Conventional buoyancy modules include circular cross sections that are identical across a longitudinal axis of the cylindrical structures. Due to the identical cross sections, a spanwise correlation/coherence of vortex shedding is established. This produces in phase net lift forces having substantially large magnitudes. When vortex shedding frequency is close to a natural frequency of the drilling riser, a resonant-vibration phenomenon known as "lock-in" occurs, which increases the amplitude of the vibrations.

Furthermore, conventional drilling riser buoyancy modules have not adopted any VIV suppression devices, while other submerged cylindrical members such as risers use fairings, strakes, or fins to break the correlation of vortex shedding along the span of the structure, which diminishes the net lift force and VIV. The fairings, strakes, or fins protrude from the surface of the cylindrical members. Thus the fairings, strakes, or fins cause larger drag forces from the flowing fluid on the submerged cylindrical members. In addition these embodiments pose difficulties in operation, transporting, handling, and installing the structural system.

Since, drilling riser buoyancy module diameters are constrained by drilling system requirements, the VIV suppression devices that protrude from the surface cannot be used. Accordingly, needs exist for effective systems and methods for buoyancy modules with indentations configured to reduce VIV, wherein different indentation patterns are configured to reduce VIV considering the directional flow of the current.

SUMMARY

Embodiments disclosed herein describe cylindrical structures or buoyancy modules (referred to hereinafter collectively and individually as "cylindrical structures") with indents configured to reduce VIV. For example, the cylindrical structures may be configured to reduce VIV for drilling risers subject to ocean currents. In embodiments, the indents may be grooves within an outer surface of the cylindrical structures, wherein the indents include parallel pairs of indents. The paired indents may be mirrored and be positioned in a helical pattern extending along the longitudinal axis of the cylindrical structures, which may be continuous or staggered.

Both indents within a pair may be cut into the outer surface of the cylindrical structure, wherein the shape of the indents may be concave in shape. For example, each of the indents may be substantially "V-shaped," forming a triangular cutout with two legs embedded within the cylindrical structure. A first leg of the indents may be substantially straight, and a second leg of the indents may be curved. In embodiments, the first legs of the pairs of indents may be positioned proximal to each other, while the second legs of the pairs of indent may be distal sides that curve back to the surface of the cylindrical indent.

Embodiments may be configured to significantly reduce drag forces exerted by flowing fluid on the cylindrical structure compared to protruded forms. Additionally, because the indents are embedded within the outer surface of the cylindrical structure, and do not protrude away from the outer surface of the cylindrical structure, embodiments may be more efficiently fabricated, transported, handled, and installed, while limiting, reducing, etc. the buoyancy loss caused by creating the indents with the cylindrical structures.

Embodiments may be optimized to improve VIV reduction efficiency corresponding to current flow in a plurality of different directions due to the mirrored or bidirectional arrangement of the pair of indents. Accordingly, irrespective of the current direction and location of the indents on the outer surface of the cylindrical structure, there may be an indent interacting and congruently positioned with the current at all times due to the inherent nature of the mirrored pairs of indents.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
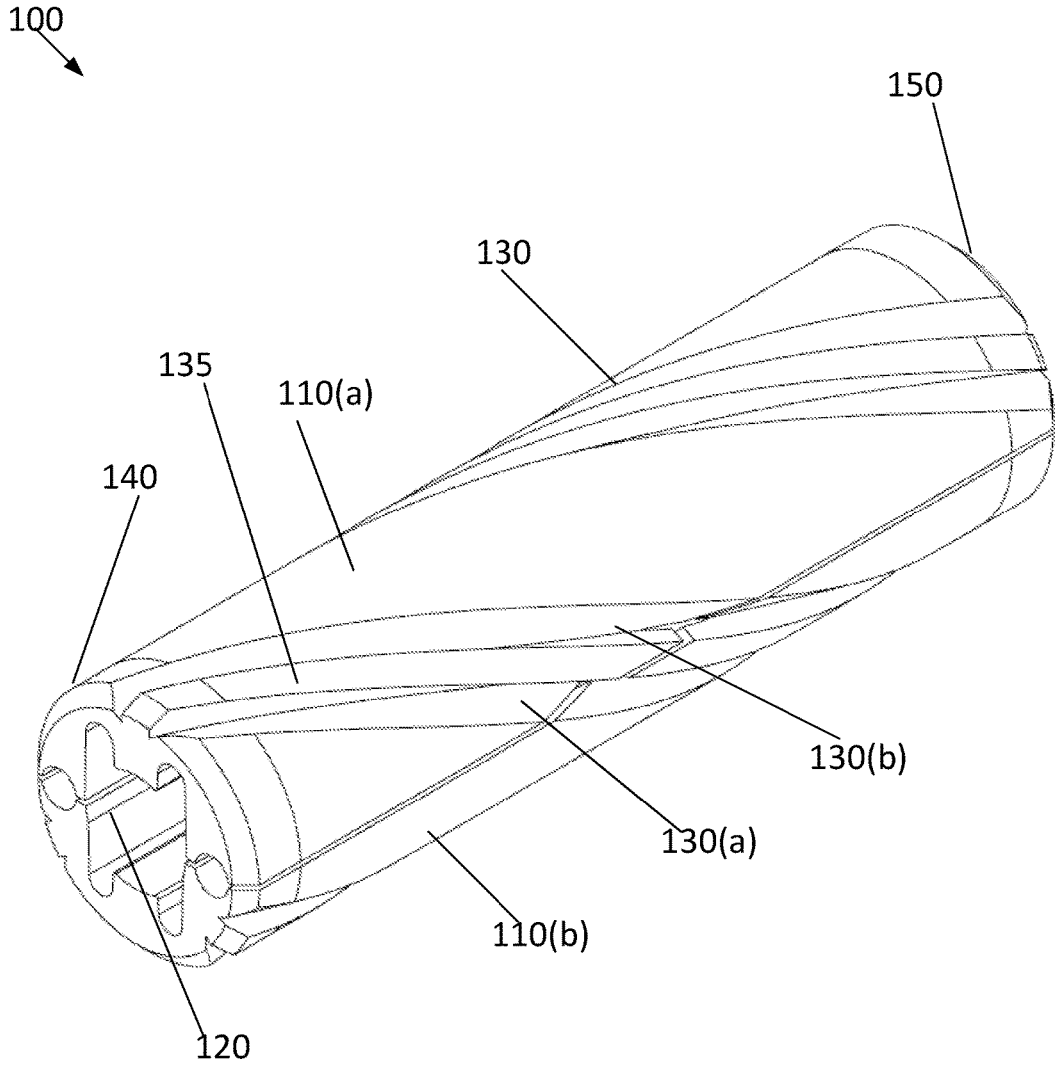
FIG. 1 depicts a cylindrical structure configured to be a drilling riser buoyancy module, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Embodiments disclosed herein describe cylindrical structures with embedded indents configured to reduce VIV. In embodiments, the indents may be positioned within an outer surface of the cylindrical structures, wherein the indents may include parallel pairs. The pairs may be mirrored, and be positioned in a helical pattern, which may be continuous or staggered.

Turning now to FIG. 1, FIG. 1 depicts a cylindrical structure 100 configured to be a drilling riser buoyancy module, according to an embodiment. A drilling riser may be a conduit that is configured to provide a temporary extension of a subsea oil well to a surface drilling facility. When used in water with a substantial depth, a drilling riser should be tensioned to maintain stability. The level of tension required is related to the weight of the drilling riser equipment, the buoyancy of the drilling riser, the forces from waves and current, the weight of internal fluids, etc. To reduce the top hookload of the drilling equipment on the surface, platform buoyancy modules are used to help maintain the required tension along the drilling riser.

Cylindrical structure 100 may be a drilling riser buoyancy module comprised of a first half 110(*a*), a second half 110(*b*), pipe orifices 120, and indents 130(*a*) and 130(*b*). Cylindrical structure 100 may be configured to be submerged in fluid, and minimize downtime caused by loop current VIV, which may increase operability of the surface drilling facility.

The two halves 110(*a*) and 110(*b*) may be configured to encompass a drilling riser pipe, wherein the drilling riser pipe may be configured to be inserted into pipe orifices 120. The drilling riser pipe may be positioned within the cylindrical structure 100. The circumferences of two halves 110(*a*) and 110(*b*) may form a cylindrical outer surface. In embodiments, two halves 110(*a*) and 110(*b*) may be coupled together.

Indents 130 may be positioned within the outer surface of cylindrical structure 100. Indents 130 may be configured to reduce VIV applied to cylindrical structure 100. Indents 130 may be notches, grooves, indentions, etc. that extend from a first end 140 of cylindrical structure 100 to a second end 150 of cylindrical structure 100. Indents 130 may be positioned on an outer surface of cylindrical structure 100, and be positioned as a circular helix extending in a direction around a longitudinal axis cylindrical structure 100.

Indents 130 may be configured to curve one hundred eighty degrees around the outer surface of cylindrical structure 100. Accordingly, the positioning of a first end of indents 130 positioned on a first end 140 of cylindrical structure 100 may be offset from a second end of indents 130 positioned on second end 150 of cylindrical structure 100. One skilled in the art may appreciate that the curvature of indents 130 around the circumference of cylindrical indents 110 from first end 140 to second end 150 may be any desired degree based on the current flows of the body of water, the shape and/or size of cylindrical structure 100, the forces applied to cylindrical structure 100, the length of cylindrical structure 100, etc. For example, indents 130 may rotate a full three hundred sixty degrees around the circumference of cylindrical structure 100 while extending from first end 140 and second end 150, sixty degrees around the circumference of cylindrical structure 100, forty five degrees around the circumference of cylindrical structure 100, etc.

Each of the indents 130 may be formed of a pair of asymmetrical indents, including a first indent 130(*a*) and a second indent 130(*b*), wherein the indents 130 within the pairs are mirror images of each. Indents 130(*a*) and 130(*b*) may be separated by a continuous ridge 135, wherein indents 130(*a*) and 130(*b*) are mirrored over ridge 135 or between a first end and a second end of the cylindrical structure. Ridge 135 may be helical and shape, and correspond to a curvature of the indents. Ridge 135 may have a variable or predetermined width, and may be comprised of types of materials based on a functional or structural integrity requirement of an associated drilling riser and/or other elements. Thus, different drilling risers may require ridges 135 with different widths and/or materials. Indents 130(*a*) and 130(*b*) may be cut into the outer surface of the cylindrical structure 100, wherein the shape of the indents 130(*a*) and 130(*b*) may be substantially "V-shaped," with two legs extending into the body of cylindrical structure. In embodiments, the first leg of indents 130(*a*) and 130(*b*) may be positioned adjacent or proximal to ridge 135, and the second leg of indents 130(*a*) and 130(*b*) may be distal to ridge 135.

A first leg of both the indents 130(*a*) and 130(*b*) may be substantially straight, and a second leg of both of the indents 130(*a*) and 130(*b*) may be curved, wherein the curvature of the second leg may be convex.

Thus, the first legs of the pairs of indents 130 may be linear legs that are positioned adjacent to each other. The length of the first leg of indents 130(*a*) and 130(*b*) may be proximate to ten percent of the diameter of cylindrical structure 100. In other words, indents 130(*a*) and 130(*b*) may have a depth that is proximate to ten percent of the diameter of cylindrical structure 100. The length of the first leg of indents 130(*a*) and 130(*b*) may be substantial enough to reduce VIV, with minimal buoyancy loss. However, one skilled in the art may appreciate that then length of the first leg of indents 130 may be greater than or less than ten percent of the diameter of cylindrical structure 130.

The second legs of the pairs of indents 130(*a*) and 130(*b*) may be non-adjacent sides that curve back to the surface of the cylindrical structure 100. Due to the mirroring and/or curvature of the non-adjacent second legs of indents 130(*a*) and 130(*b*) over ridge 135, indents 130 may be optimized to improve VIV reduction efficiency corresponding to fluid flow in a plurality of different directions. Accordingly, irrespective of the current direction, there will be at least one indent 130(*a*) and/or 130(*b*) facing the current at all times to due to the positioning and shape of indents 130(*a*) and 130(*b*).

Cylindrical structure 100 may include any desired number of pairs of indents 130. Each of the pairs of indents 130 may be evenly offset on the circumference of cylindrical structure 100 from adjacent pairs of indents 130, wherein the degree of offset may be based on the number of pairs of indents 130. For example, three to four pairs are commonly used in a starshape pattern.

Figure 2:
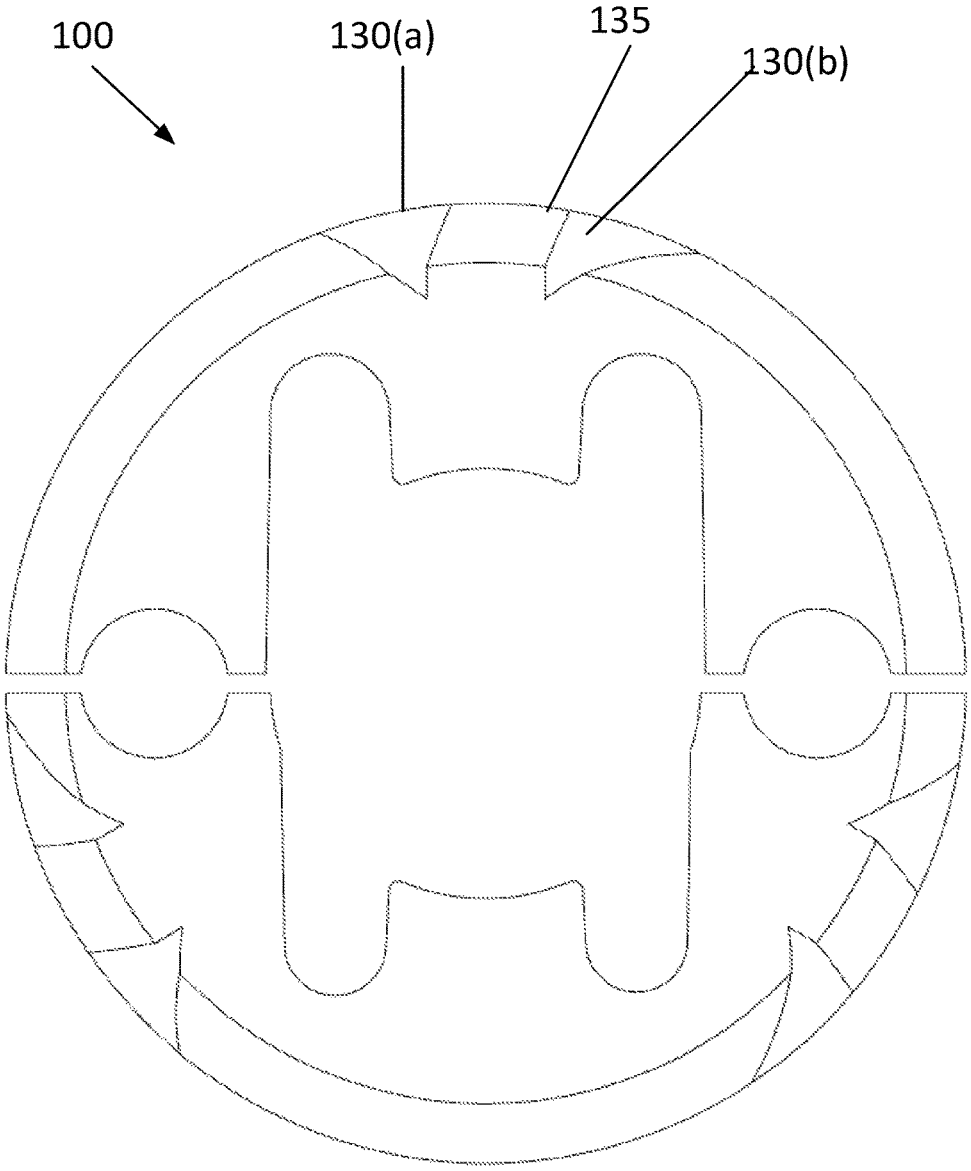
FIG. 2 depicts a cross sectional view of a cylindrical structure configured to be a drilling riser buoyancy module, according to an embodiment.

FIG. 2 depicts a cross sectional view of cylindrical structure 100, according to an embodiment. Elements depicted in FIG. 2 may be substantially the same as those discussed above. For the sake of brevity, a further description of these elements is omitted.

As depicted in FIG. 2, cylindrical structure 100 may include three pairs of indents 130. Each of the pairs of indents 130 may be evenly offset from adjacent pairs of indents 130, wherein the degree of offset may be based on the number of pairs of indents 130. For example, as depicted in FIG. 2, there are three pairs of indents 130, wherein each of the pair of indents 130 is offset one hundred twenty degrees from the adjacent pairs of indents 130. In embodiments with other numbers of pairs of indents 130, the offset degree for each of the pair of indents 130 may be three hundred sixty degrees divided by the number of pairs of indents 130. For example, in embodiments with four pairs of indents, the pair of indents may be offset by ninety degrees from each other.

Figure 3:
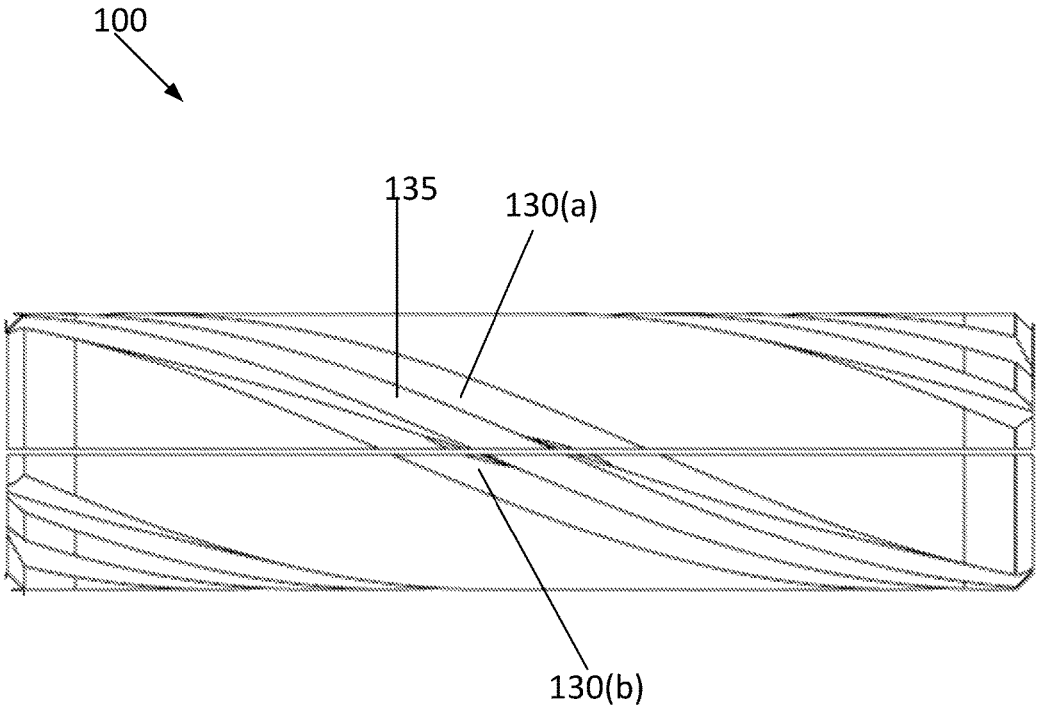
FIG. 3 depicts a side view of a cylindrical structure configured to be a drilling riser buoyancy module, according to an embodiment.

FIG. 3 depicts a side view of cylindrical structure 100, according to an embodiment. Elements depicted in FIG. 3 may be substantially the same as those discussed above. For the sake of brevity, a further description of these elements is omitted.

As depicted in FIG. 3, each of the pairs of indents 130(*a*) and 130(*b*) are curved in parallel to each other, such that the shape of indents 130(*a*) and 130(*b*) are congruent. As further depicted in FIG. 3, indents 130 include a helical design that is configured to partially wrap around the circumference of cylindrical structure 100. However, in other embodiments, the helical design of indents 130 may include a sharper or broader slope to provide a desired pitch to increase efficiency. As further depicted in FIG. 3, the angle of the helical design may change as indents 130 approach a center of cylindrical structure 100, wherein the angle may increase or decrease closer to the center of cylindrical structure 100.

Figure 4:
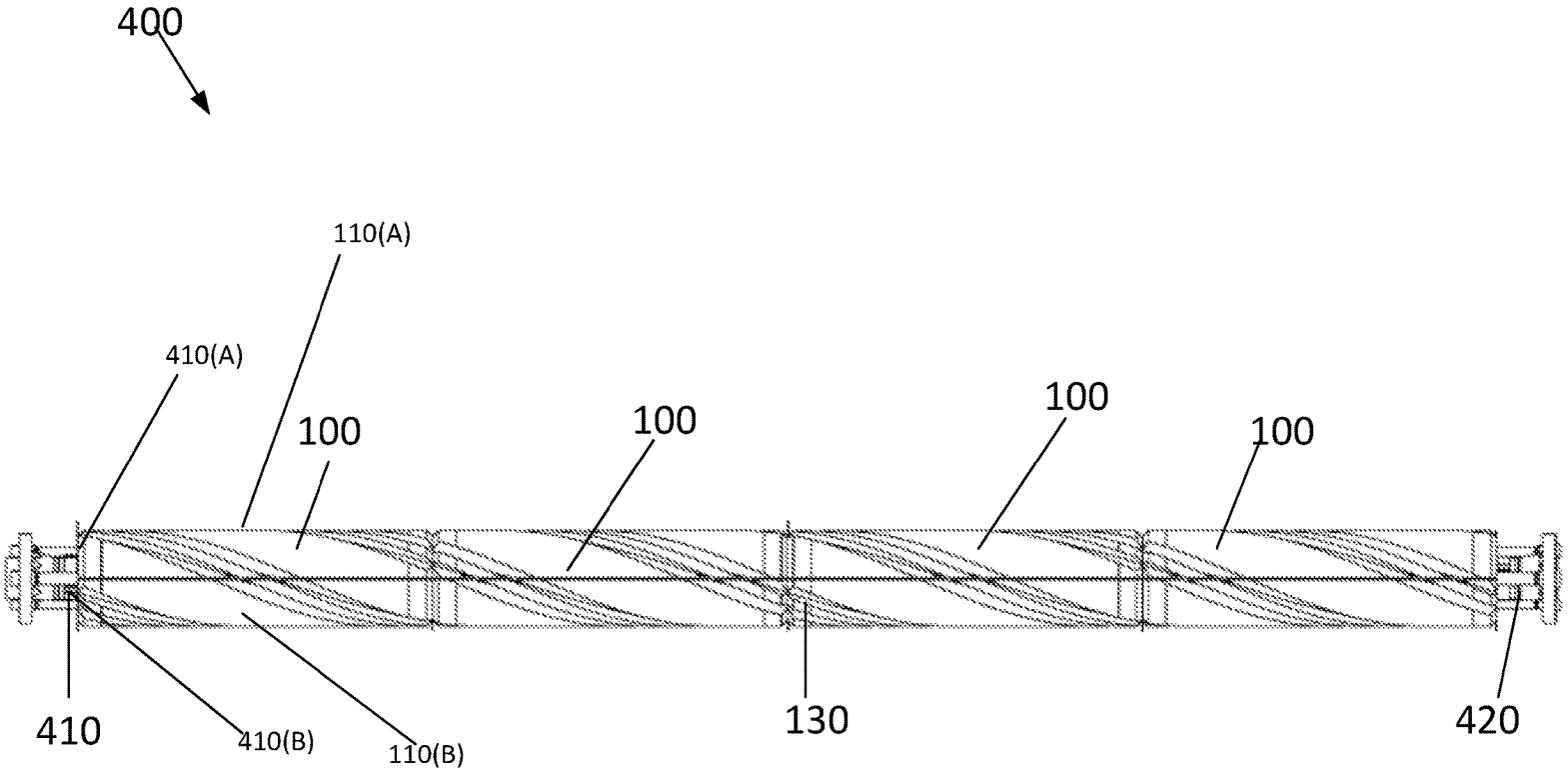
FIG. 4 depicts a side view of a drilling riser joint with a plurality of cylindrical structures 100 being coupled to each other, according to an embodiment.

FIG. 4 depicts a side view of drilling riser 400 with a plurality of cylindrical structures 100 being coupled to each other, according to an embodiment. Elements depicted in FIG. 4 may be substantially the same as those discussed above. For the sake of brevity, a further description of these elements is omitted.

As depicted in FIG. 4, the plurality of cylindrical structures 100 may be coupled together, wherein indents 130 on a first end of a first cylindrical structure 100 may be aligned with indents 130 on a second end of a second cylindrical structure 100. Accordingly, drilling riser 400 may include continuous, bi-directional, helical indents 130 extending from the first end 410 of drilling riser 400 to second end 420 of drilling riser 400, wherein an upper portion 410(*a*) of drilling riser 400 is covered by first half 110(*a*) and a lower portion 410(*b*) or drilling riser 400 is covered by second half 110(*b*).

Figure 5:
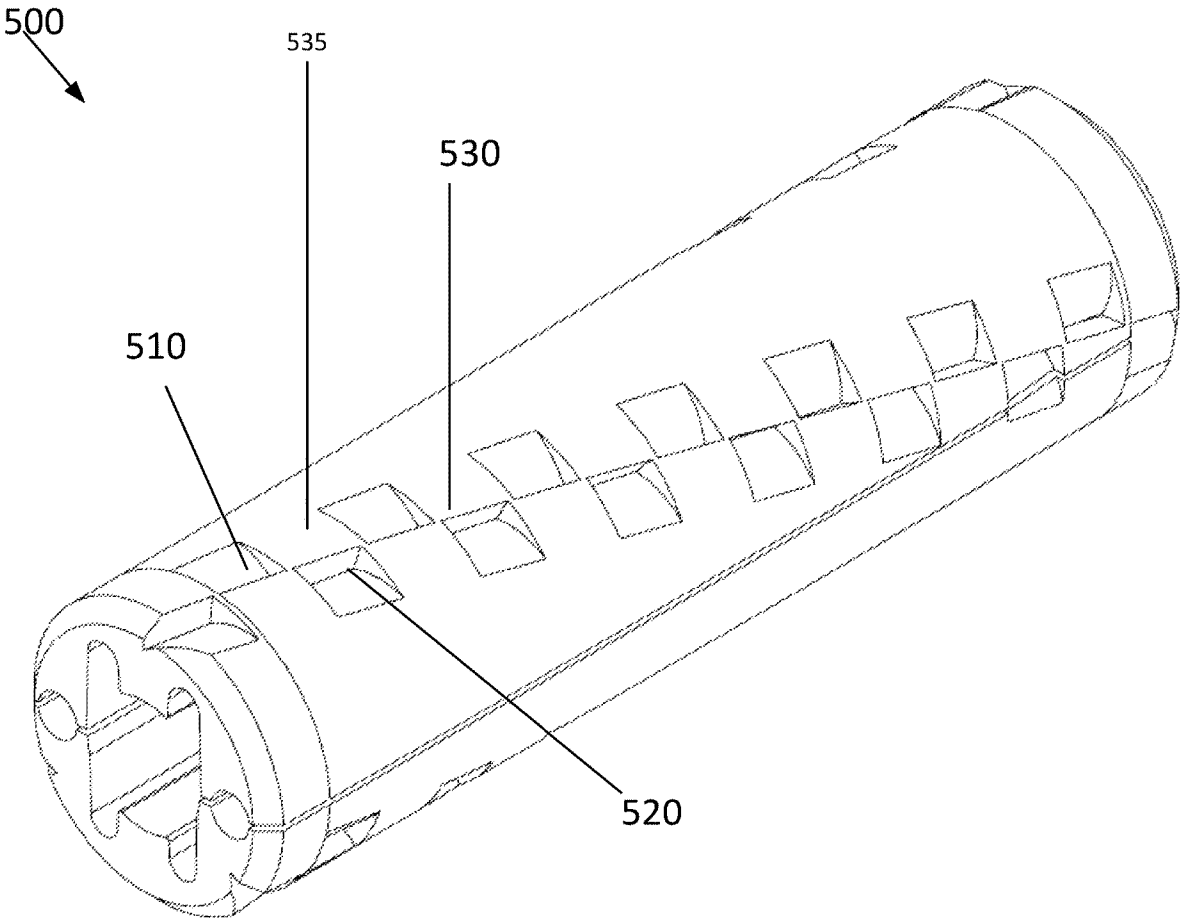
FIG. 5 depicts a cylindrical structure configured to be a drilling riser buoyancy module, according to an embodiment.

FIG. 5 depicts a cylindrical structure 500 configured to be a drilling riser buoyancy module, according to an embodiment. Cylindrical structure 500 may be used in combination with, as an alternative to, and/or in addition to cylindrical structure 100.

In embodiments, axis 530 may be a helical axis with a curve between the first and second ends of cylindrical structure 500. Each of the V-shaped notches 510, 520 may have a first leg and a second leg, wherein the V-shaped notches 510, 520 form square cutouts embedded within cylindrical structure 500. The first leg of the V-shaped notch may be a straight leg, and the second leg of the V-shaped notched may be curved, wherein the curvature of the second leg curves inward towards the longitudinal axis of cylindrical structure 500.

Cylindrical structure 500 may include a plurality of alternating V-shaped notches, including a first series of first notches 510, and a second series of second notches 520 that are positioned on opposite sides of an axis 530, wherein the axis 530 extends from a first end of cylindrical structure 500 to a second end of cylindrical structure. In embodiments, as shown in the cross sections 530, 540, notches 510, 520 may be configured to reduce VIV considering the directional flow of the current and the positioning of notches 510. In embodiments, the V-shaped notches 510, 520 may be misaligned such notches 510 are positioned cattycorner from each other across axis 530, such that a first leg of notch 510 is positioned on a first side of axis 530, and a first leg of notch 520 is positioned on a second side of axis 530. Thus, the first legs of notches 510, 520 may create alternating continuous grooves from a first end of cylindrical structure to a second end of cylindrical structure, and non-continuous grooves 535 on both sides of axis 530.

In embodiments, a plurality of cylindrical structures 500 may be coupled together, wherein notches and axis on a first end of a first cylindrical structure 500 may be aligned with notches and axis on a second end of a second cylindrical structure 500. Accordingly, a drilling riser may include continuous, bidirectional, helical notches and axis extending from the first end of a drilling riser to the second end of the drilling riser.

Figure 6:
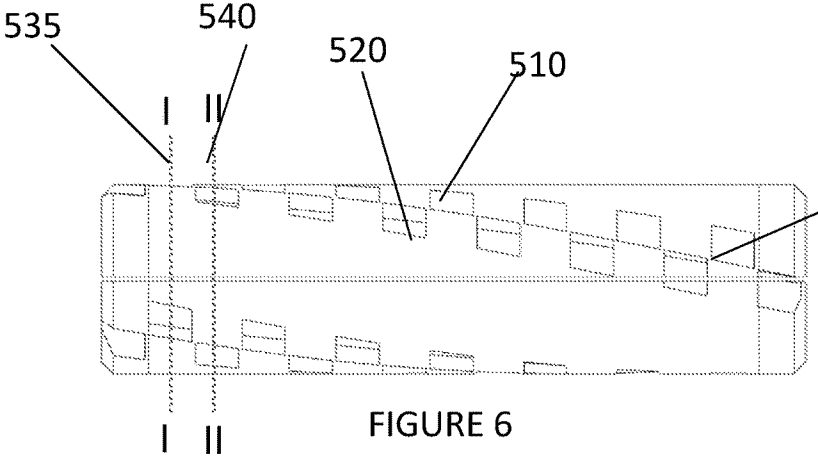
FIG. 6 depicts a cylindrical structure identifying multiple cross sections, according to an embodiment.

FIG. 6 depicts multiple cross sectional views of cylindrical structure 500, according to an embodiment. Elements depicted in FIG. 6 may be substantially the same as those discussed above. For the sake of brevity, a further description of these elements is omitted.

As depicted in FIG. 6, at each a cross section of cylindrical structure 500 there may only be one set of notches 510, 520 corresponding to each axis 530. The localized V-shape minimizes the loss of buoyancy materials. As depicted in FIG. 6, at each a cross section of cylindrical structure 500 there may only be one set of notches 510 corresponding to each axis 530. The localized V-shape minimizes the loss of buoyancy materials. The staggered arrangement of notches may improve the VIV reduction efficiency corresponding to opposite current directions with minimal buoyancy loss.

Figure 7:
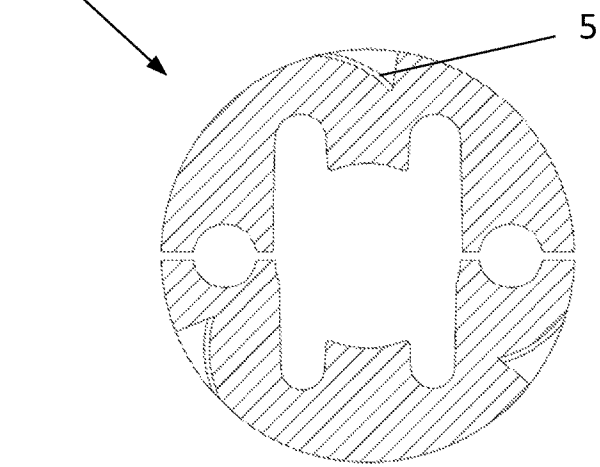
FIG. 7 depicts a first cross section of a cylindrical structure, according to an embodiment.
Figure 8:
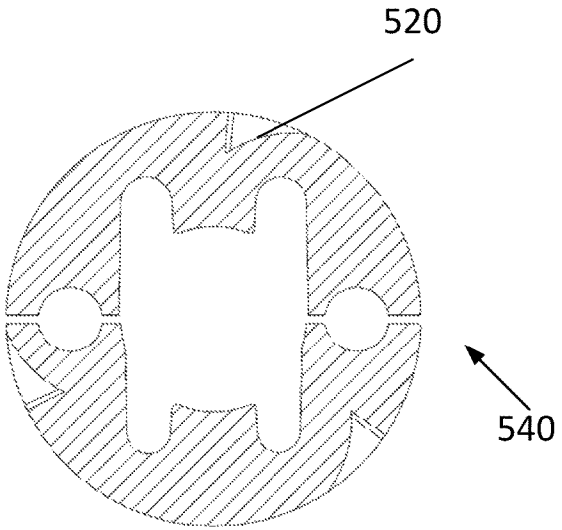
FIG. 8 depicts a second cross section of a cylindrical structure, according to an embodiment.

FIG. 7 depicts a first cross sectional view 535 of cylindrical structure 500, according to an embodiment, and FIG. 8 depicts a second cross sectional view 540 of cylindrical structure 500. Elements depicted in FIGS. 7 and 8 may be substantially the same as those discussed above. For the sake of brevity, a further description of these elements is omitted.

As depicted in FIG. 7, a first set of notches 510 may have V-shaped cross sectional concave indents. Further, as depicted in FIG. 8, a second set of notches 520 may have V-shaped cross sectional concave indents. As depicted in FIGS. 7 and 8, the curvature of the opposing sets of notches may be curved towards each other. However, in other embodiments, the curvature of opposing sets of notches may be away from each other.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A cylindrical shaped buoyancy module for a drilling riser comprising:

a first series of first notches positioned on a first side of an axis, wherein the first series of first notches form a non-continuous groove from a first end to a second end of the cylindrical shaped buoyancy module, the axis being helical and extending around a circumference of the cylindrical shaped buoyancy module from the first end of the cylindrical shaped buoyancy module to the second end of the cylindrical shaped buoyancy module;

a second series of second notches positioned on a second side of the axis, wherein the first series of first notches are misaligned from the second series of second notches in a direction from the first end to the second end of the cylindrical shaped buoyancy module.

2. The cylindrical shaped buoyancy module of claim 1, wherein the series of first notches and the series of second notches form alternating continuous notches extending along the axis from the first end to the second end of the cylindrical shaped buoyancy module.

3. The cylindrical shaped buoyancy module of claim 1, wherein the series of first notches and the series of second notches are rectangular shaped cutouts embedded within the cylindrical shaped buoyancy module.

* * * * *